US011607045B2

(12) United States Patent
Hamilton

(10) Patent No.: US 11,607,045 B2
(45) Date of Patent: Mar. 21, 2023

(54) PORTABLE FOLDING SEAT AND BACK SYSTEM TO RELIEVE BACK DISCOMFORT USING VARIOUS THERAPEUTIC METHODS

(71) Applicant: Kenneth Bernard Hamilton, Westfield, MA (US)

(72) Inventor: Kenneth Bernard Hamilton, Westfield, MA (US)

( * ) Notice: Subject to any disclaimer, the term of this patent is extended or adjusted under 35 U.S.C. 154(b) by 83 days.

(21) Appl. No.: 17/301,135

(22) Filed: Mar. 26, 2021

(65) Prior Publication Data

US 2021/0298482 A1 Sep. 30, 2021

Related U.S. Application Data

(60) Provisional application No. 63/001,644, filed on Mar. 30, 2020.

(51) Int. Cl.

| | |
|---|---|
| ***A47C 7/42*** | (2006.01) |
| ***A47C 31/00*** | (2006.01) |
| ***A47C 7/02*** | (2006.01) |
| ***A41D 1/04*** | (2006.01) |
| ***A41D 13/11*** | (2006.01) |
| ***A41D 15/00*** | (2006.01) |

(52) U.S. Cl.

CPC ..... *A47C 7/425* (2013.01); *A41D 1/04* (2013.01); *A41D 13/1161* (2013.01); *A41D 15/00* (2013.01); *A47C 7/0213* (2018.08); *A47C 31/003* (2013.01); *A41D 2200/20* (2013.01)

(58) Field of Classification Search

None

See application file for complete search history.

(56) References Cited

U.S. PATENT DOCUMENTS

| | | | | |
|---|---|---|---|---|
| 4,047,757 A | | 9/1977 | Eames et al. | |
| 4,161,337 A | | 7/1979 | Ross et al. | |
| 4,362,334 A | | 12/1982 | Ross et al. | |
| 4,753,482 A | * | 6/1988 | Warren | A61G 5/00 5/653 |
| 4,793,652 A | | 12/1988 | Hannah et al. | |
| 4,824,169 A | | 4/1989 | Jarrell | |
| 4,887,865 A | | 12/1989 | Dawidzon | |
| 4,908,891 A | | 3/1990 | Blagg | |
| 5,288,132 A | | 2/1994 | Vaughn | |

(Continued)

FOREIGN PATENT DOCUMENTS

| | | | | |
|---|---|---|---|---|
| CH | 684778 A5 | * | 12/1994 | A61H 23/0263 |
| CN | 201160674 Y | * | 12/2008 | A47C 7/021 |

(Continued)

*Primary Examiner* — David E Allred

(74) *Attorney, Agent, or Firm* — Dunlap Bennett & Ludwig, PLLC

(57) ABSTRACT

A portable therapeutic unit and system for treating a back, a neck, or the back and the neck of a user is disclosed. The therapeutic unit includes a first seat, a back support, a hinge, and a metal back. The first seat is designed for the user to sit thereupon. The back support is designed to support a back of the user. The hinge pivotally connects the first seat and the back support. The metal back is connected to the back support, with the metal back magnetically coupling with an attachment magnet. Further, the attachment magnet couples to a therapeutic aid to deliver treatment to the user.

15 Claims, 4 Drawing Sheets

(56) References Cited

U.S. PATENT DOCUMENTS

| | | | | |
|---|---|---|---|---|
| 5,776,085 | A * | 7/1998 | Stone | A61H 37/00 601/99 |
| 5,848,984 | A | 12/1998 | Bachar et al. | |
| 6,086,152 | A | 7/2000 | Zeller | |
| 6,206,463 | B1 | 3/2001 | Whigham | |
| 6,346,088 | B1 * | 2/2002 | Stone | A61H 37/00 601/99 |
| 7,083,236 | B1 | 8/2006 | Smith | |
| 7,255,394 | B2 | 8/2007 | Ogura | |
| 7,438,356 | B2 | 10/2008 | Howman et al. | |
| 7,775,587 | B1 | 8/2010 | Reed | |
| 8,534,755 | B2 | 9/2013 | Nickerson | |
| 9,687,078 | B2 | 6/2017 | Mitchell | |
| 9,717,342 | B2 | 8/2017 | Bates | |
| 9,918,554 | B2 | 3/2018 | Song | |
| 10,556,523 | B1 * | 2/2020 | Rajasingham | B64D 11/0619 |
| 2005/0184573 | A1 * | 8/2005 | Stone | A61G 15/125 297/409 |
| 2010/0045080 | A1 | 2/2010 | Haugan | |
| 2013/0193726 | A1 * | 8/2013 | Rajasingham | B64D 11/06 297/216.12 |
| 2016/0066694 | A1 | 3/2016 | Blakeney | |
| 2021/0244595 | A1 * | 8/2021 | Christensen | A61G 15/125 |

FOREIGN PATENT DOCUMENTS

| | | | | |
|---|---|---|---|---|
| CN | 212730346 U | * | 3/2021 | |
| CN | 213501963 U | * | 6/2021 | |
| CN | 215741640 U | * | 2/2022 | |
| GB | 2568266 A | * | 5/2019 | A61H 39/04 |
| KR | 20100034663 A | * | 4/2010 | A61H 23/0263 |

* cited by examiner

PORTABLE FOLDING SEAT AND BACK SYSTEM TO RELIEVE BACK DISCOMFORT USING VARIOUS THERAPEUTIC METHODS

CROSS-REFERENCE TO RELATED APPLICATION

This application claims the benefit of priority of U.S. provisional application No. 63/001,644, filed Mar. 30, 2020, the contents of which are herein incorporated by reference.

BACKGROUND OF THE INVENTION

The present invention relates to therapeutic relief to back and neck areas of the human body and, more particularly, to relief of diverse types of back discomfort using a plurality of therapeutic methods with a singular unit.

There many reasons a variety of users would require some type of back or neck relief/treatment. For example, elderly individuals without a lot of mobility often require medical or moisturizing treatments to their back region, but they need assistance from another individual in order to apply the treatments. In a similar vein, an individual may be stung by an insect on his/her back and need a way to apply an ointment. Many individuals suffer from back pain, and require specific placement of a treatment option, such as a heating pad. Many other individuals need some type of treatment for a stiff neck, but few have the money or space for a chair that gives a neck massage. Sports injuries require exact placement of therapeutic aids, such as heat, cold, and other forms of stimulus. Most of the ailments described herein either require or would benefit from the assistance of a second individual, which is very oftentimes not possible.

Other existing devices are specific to the treatment desired. These are individual solutions that address individual back discomfort problems (such as the ones described above), but from a holistic perspective (i.e., the solution of multiple back and neck issues) are lacking.

As can be seen, there is a need for a system and method for interchangeably targeting and treating a variety of specific regions on a user's back and neck region with a single device.

SUMMARY OF THE INVENTION

In one aspect of the present invention, a therapeutic unit for treating a back, a neck, or the back and the neck of a user comprises: a first seat configured for the user to sit thereupon; a back support configured to support a back of the user; a hinge pivotally connecting the first seat and the back support; and a metal back connected to the back support, the metal back being configured to magnetically couple with an attachment magnet, the attachment magnet being adapted to couple to a therapeutic aid.

In another aspect of the present invention, a therapeutic system for treating a back, a neck, or the back and the neck of a user comprises: a therapeutic unit comprising: a first seat configured for the user to sit thereupon; a back support configured to support a back of the user; a hinge pivotally connecting the first seat and the back support; and a metal back connected to the back support; and an attachment magnet magnetically coupled with the metal back, the attachment magnet being adapted to couple to a therapeutic aid.

In yet another aspect of the present invention, a therapeutic system for treating a back, a neck, or the back and the neck of a user comprises: a therapeutic unit comprising: a first seat configured for the user to sit thereupon; a back support configured to support a back of the user; a hinge pivotally connecting the first seat and the back support; and a metal back connected to the back support; an attachment magnet magnetically coupled with the metal back; and a therapeutic aid coupled to the attachment magnet.

In certain embodiments, there is provided a singular folding portable seat and back unit, with the back portion of the unit accommodating movement of different therapeutic means of remedy to the back by the use of magnetic placement. Advantageously, a single device can provide a single remedy for multiple neck and back problems. Further, accessories that connect via magnetic attraction may be used, such as a vibrating neck massager or alternating target punches may be incorporated.

These and other features, aspects and advantages of the present invention will become better understood with reference to the following drawings, description, and claims.

DETAILED DESCRIPTION OF THE INVENTION

Figure 1:
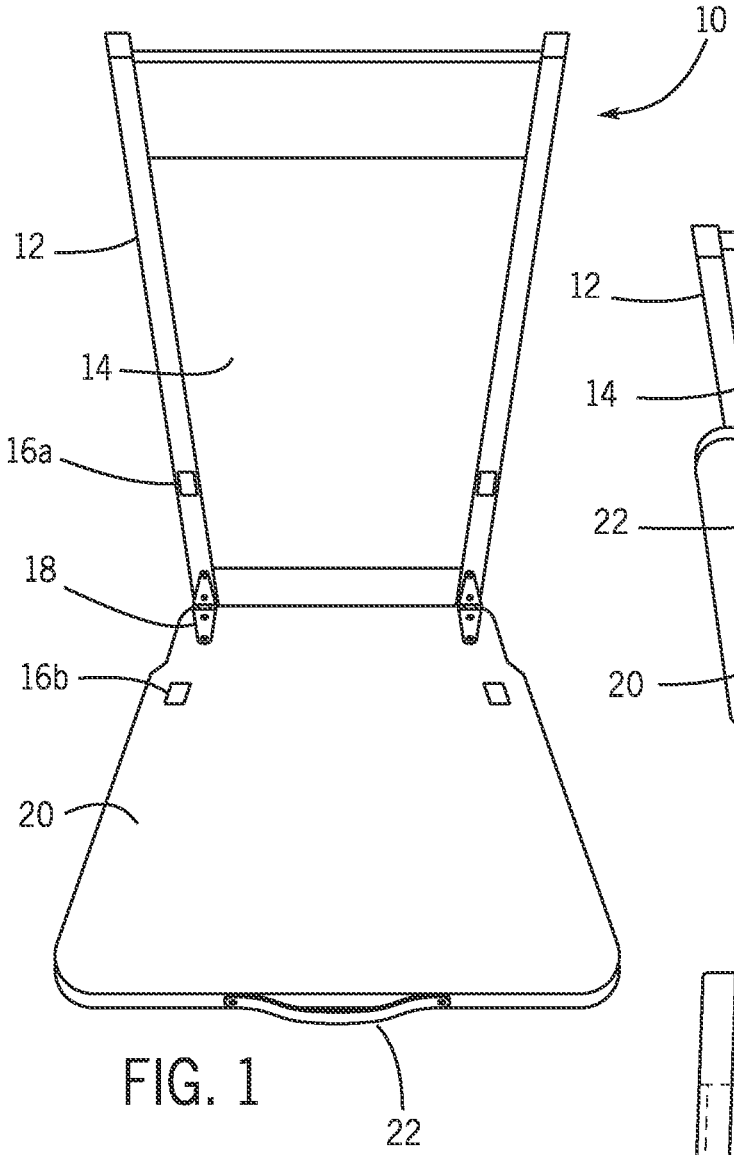
FIG. 1 is a front perspective view of an embodiment of the present invention, shown in an open position.
Figure 3:
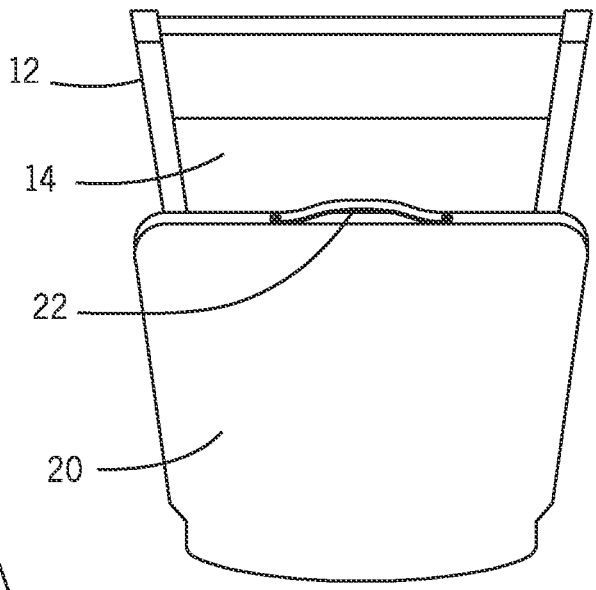
FIG. 3 is a front perspective view of the embodiment of the present invention, shown in a closed/folded position.
Figure 2:
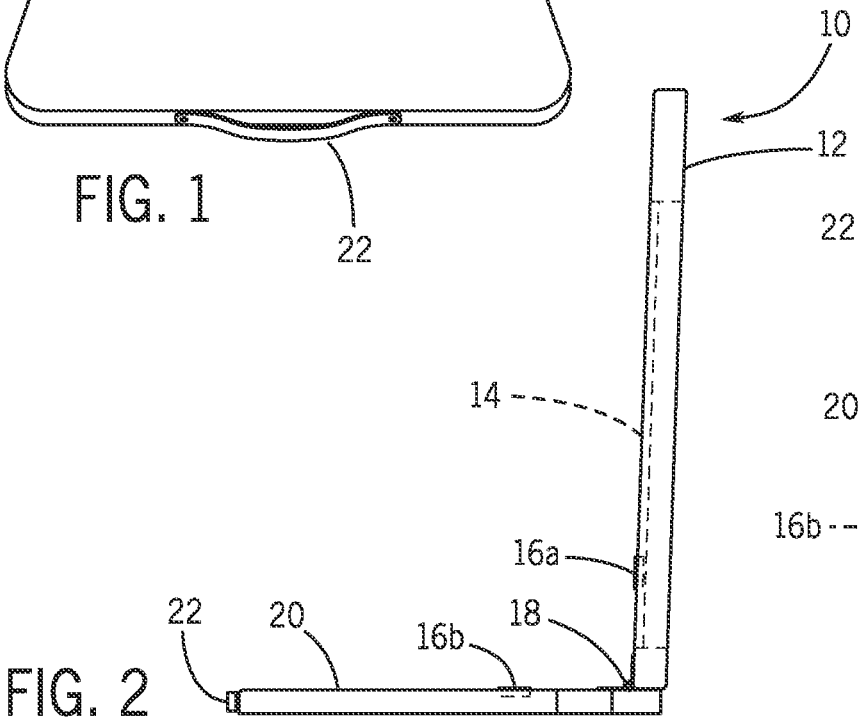
FIG. 2 is a side elevation view of the embodiment of the present invention, shown in the open position.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, one embodiment of the present invention is a portable therapeutic unit and system for treating a back, a neck, or the back and the neck of a user. As part of the embodiment, the therapeutic unit includes a first seat, a back support, a hinge, and a metal back. The first seat is designed for the user to sit thereupon. The back support is designed to support a back of the user. The hinge pivotally connects the first seat and the back support. The metal back is connected to the back support, with the metal back magnetically coupling with an attachment magnet. Further, the attachment magnet couples to a therapeutic aid to deliver various forms of treatment to the user.

In general, preferred embodiments of the present invention include six components. In certain embodiments, only these six components are provided (i.e., embodiments of the present invention consist essentially of these components), making this a simple unit that solves many problems. The first component is a bottom seat upon which a user sits. The second component is a back support which is elongated height-wise to accommodate varying height individuals. The third component is a pivot joint (such as a pivot pin or one or more hinges), which connects the bottom seat to the back support. The back support is configured such that it attracts a magnet, with the fourth component being the ferromagnetic metal surface connected to the back support. The fifth component is a handle or carry strap to assist with portability. The sixth component is a magnet sufficiently strong to support whatever therapeutic aid or accessory is attached to it. These components (when the magnet is coupled to the metal surface) form a unit that can be supported by the chair type of an individual's choosing.

In accordance with the present invention, various therapeutic aids or accessories may be selected from by a user for use with embodiments of the present invention. For example, a suitable surface may be provided that is configured to relieve a user's itch, which connects to the magnet. Further a vibration pad that connects to the magnet may be provided. Another therapeutic component that may be provided is a heating surface, which may, for example, attach to the vibration pad whether vibration is or isn't used. Finally, a removable, washable surface for applying ointments may be provided and can be attached to the vibration pad whether vibration is or isn't used.

The hinge or joint (such as a pivot pin) allows the seat and back to open and close, with the magnetic material on the back facilitating selective couplings of many systems of remedy/treatment. The seat and back support, when folded, allows for easy portability and storage. When the seat and back support are opened, this unit can open to approximately ninety degrees and can be used with a simple folding chair or, by way of example, a user's favorite plush chair—the unit just needs to be set in place. Essentially, it can be used on any chair or stable seating support (e.g., a couch, a sofa, a bench, and other structures a user could sit on) anywhere. The back support (which may be formed from a ferromagnetic material or provided with a separate metal plate) of the unit accepts magnets via magnetic attraction, which facilitates the specific target of the accessories provided for relief/therapies to the neck and back areas.

Various circumstances and user considerations are addressed by embodiments of the present invention, include age of the user, whether the user may be alone, and various disabilities the user may have. The therapeutic aid serving as a scratching device facilitates the relief of an itch that can't be reached. The vibration element or pad facilitates the massage relief of a specific area. The heat element facilitates and/or massages a specific area. The removable, washable surface may be used with or without vibration and is configured to apply lotion or ointment to a specific area of the back. Specific area relief may be dictated by magnetic placement. Embodiments of the present invention allow the interchange and point placement of multiple therapies such as, but not limited to: itch relief, moisturizing, application of ointment, relief from tension, soreness, strain, injury, or even just for relaxation. Consequently, users can configure the device in whatever way that will best suit their needs. An unlimited number of therapeutic aids may be developed to function with embodiments of the present invention.

Referring now to FIGS. 1-10, a portable, folding therapeutic seat and back unit 10 is disclosed. The therapeutic unit 10 includes a back support 12 that has a magnetic metal back 14 coupled thereto or embedded therewithin (see the phantom lines in FIGS. 2 and 4), a seat 20, with the back support 12 and seat 20 being coupled via one or more hinges 18. The back support 12 is sized such that it extends along the entirety of the back of any size individual, tall or short. The magnetic metal back 14 is configured such that it covers a substantial portion of the back support 12 (i.e., a majority of the region of the back support 12 that would physically engage a user's back when he/she sits upon the unit 10), and it is what facilitates the interchange and point placement of a user's therapy of choice.

Figure 4:
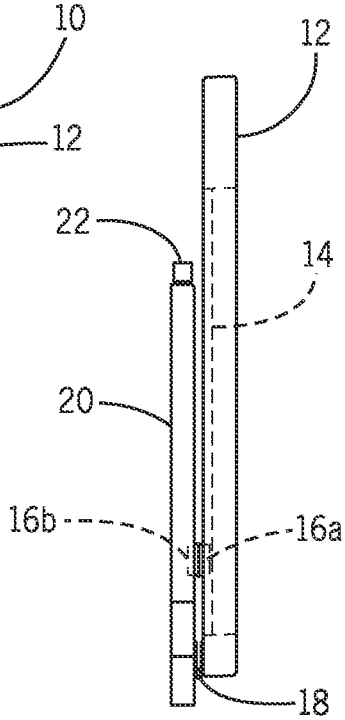
FIG. 4 is a side elevation view of the embodiment of the present invention, similar to FIG. 2, showing the embodiment in the closed/folded position.
Figure 5:
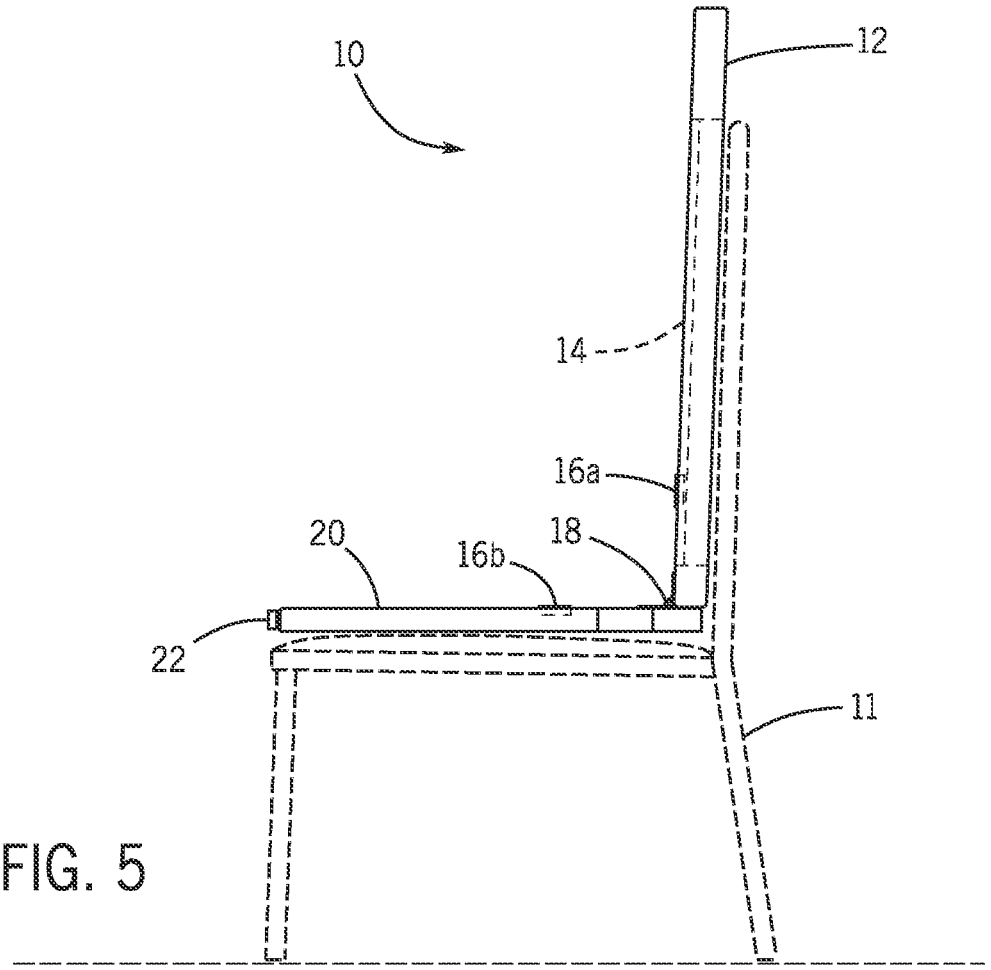
FIG. 5 is a side elevation view of the embodiment of the present invention, shown in use on a generic chair.
Figure 6:
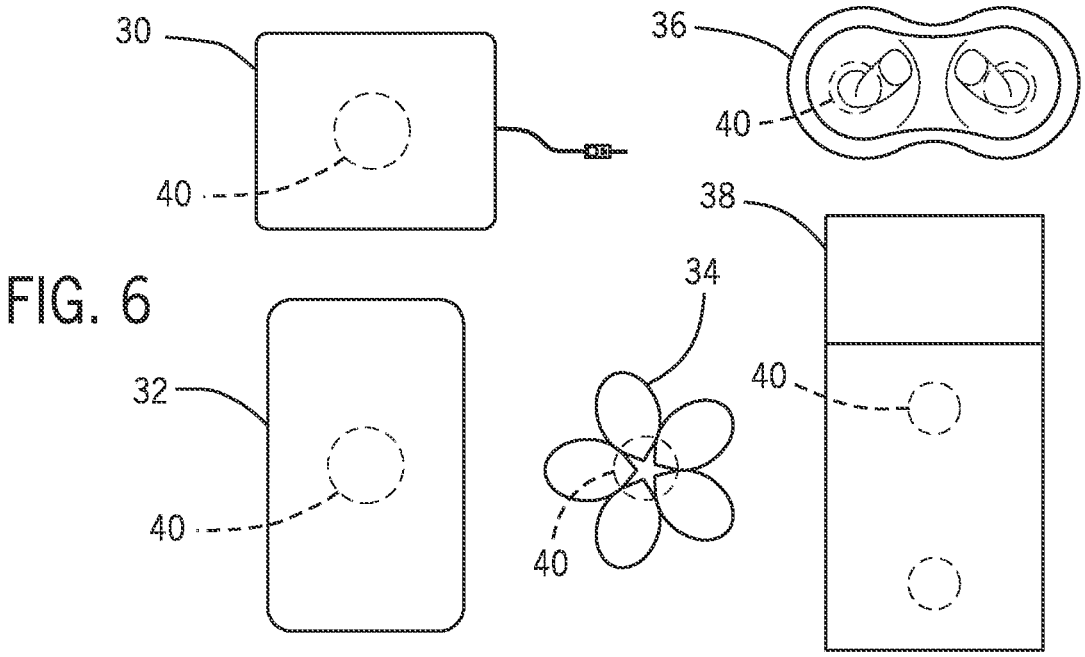
FIG. 6 shows an assortment of therapeutic accessories of the embodiment of the present invention.

It will be appreciated by those with skill in the art that the hinge structure may take any appropriate form, including, but not limited to, butt hinges and pivot pins. When unfolded and in use (e.g., FIGS. 1 and 2), the back support 12 and seat 20 form approximately a ninety-degree angle relative to one another. When folded (e.g., FIGS. 3 and 4), the back support 12 and seat 20 run parallel to one another. As shown in FIG. 4, first connectors 16*a* couple to respective second connectors 16*b*. These connectors may be, by way of example, hook and loop fasteners or magnets. A handle 22 or other carrying strap to aid in portability when the therapeutic unit 10 is folded.

Figure 7:
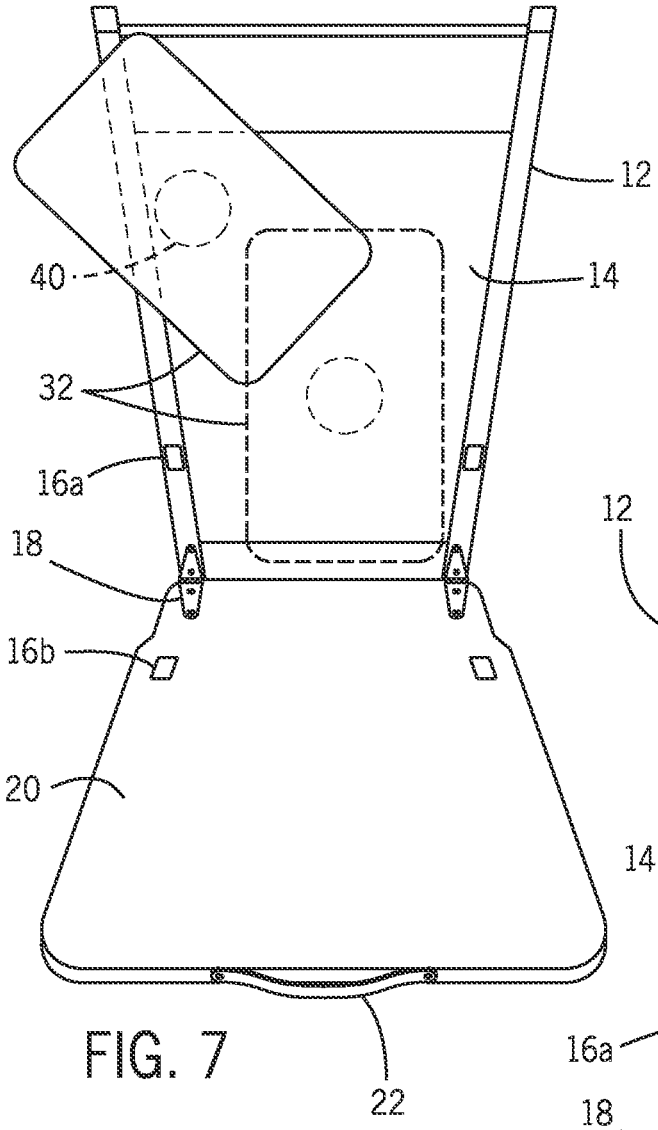
FIG. 7 is a front perspective view of the embodiment of the present invention, similar to FIG. 1, showing a first therapeutic aid of the present invention.
Figure 8:
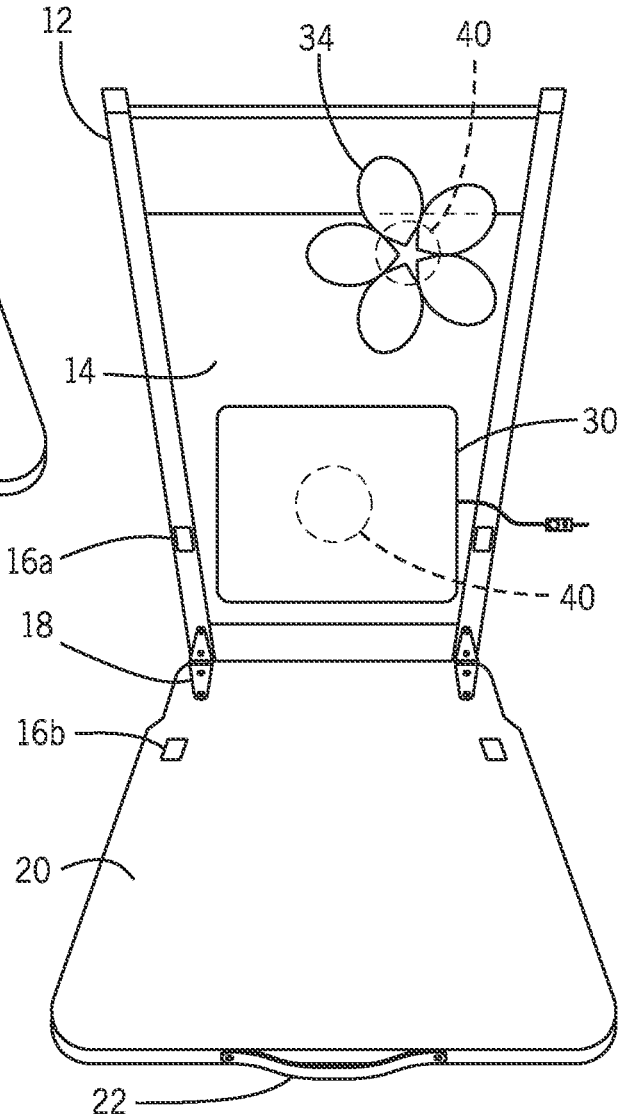
FIG. 8 is a front perspective view of the embodiment of the present invention, similar to FIG. 1, showing two more therapeutic aids of the present invention, in use.

In accordance with the present invention, one or more strong attachment magnets 40 are provided to couple with the metal back 14, as shown in FIGS. 7-10. These attachment magnet(s) 40 are what allow the various therapeutic aids to be coupled to the metal back 14 and to adjust placement of the therapeutic aids. FIG. 7 shows adjustable placement of a cushion 32, which is illustrated in solid and phantom lines. In certain embodiments, the attachment magnet(s) 40 may be removable from the therapeutic aid, while in others, the attachment magnet(s) 40 may be permanently attached to the therapeutic aid. The magnetic attraction between the magnet(s) and the metal back 14 is sufficiently strong such that the attachment magnet(s) 40 remain on the therapeutic unit 10 and are simply slid to the location needed for treatment. Accordingly, the attachment magnet(s) 40 can be positioned to pinpoint the exact region of a user's body in need of treatment.

Figure 9:
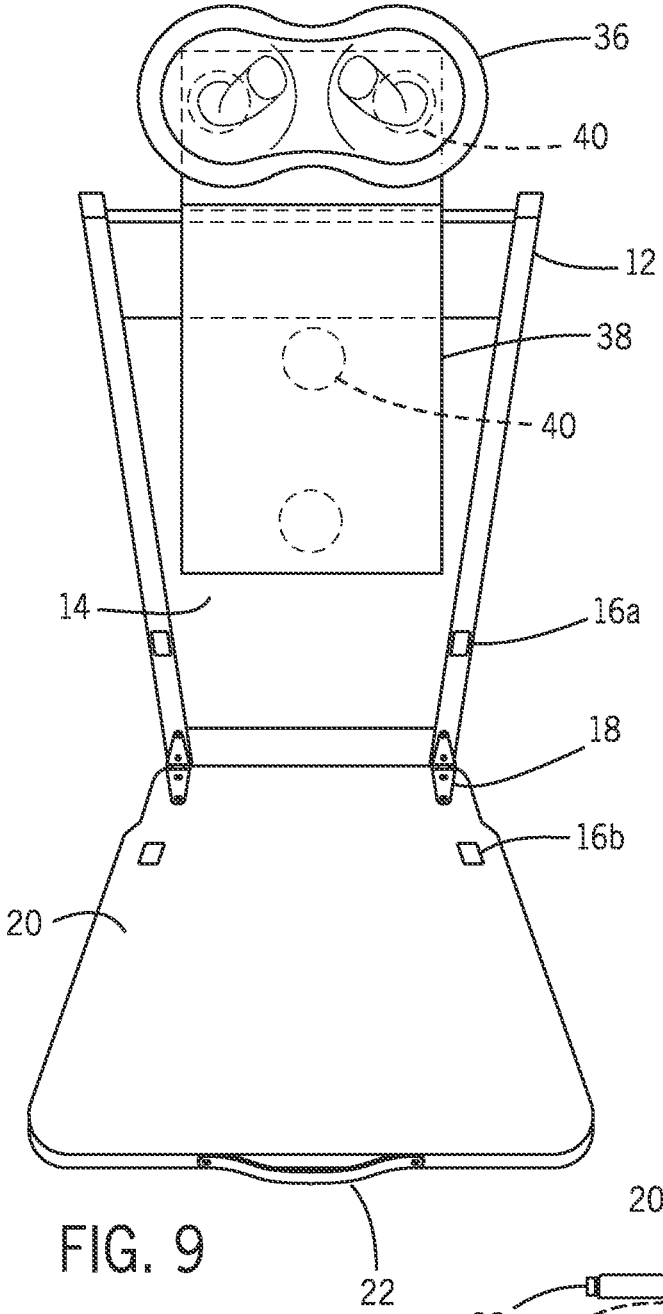
FIG. 9 is a front perspective view of the embodiment of the present invention, similar to FIG. 1, showing yet another therapeutic aid of the present invention.
Figure 10:
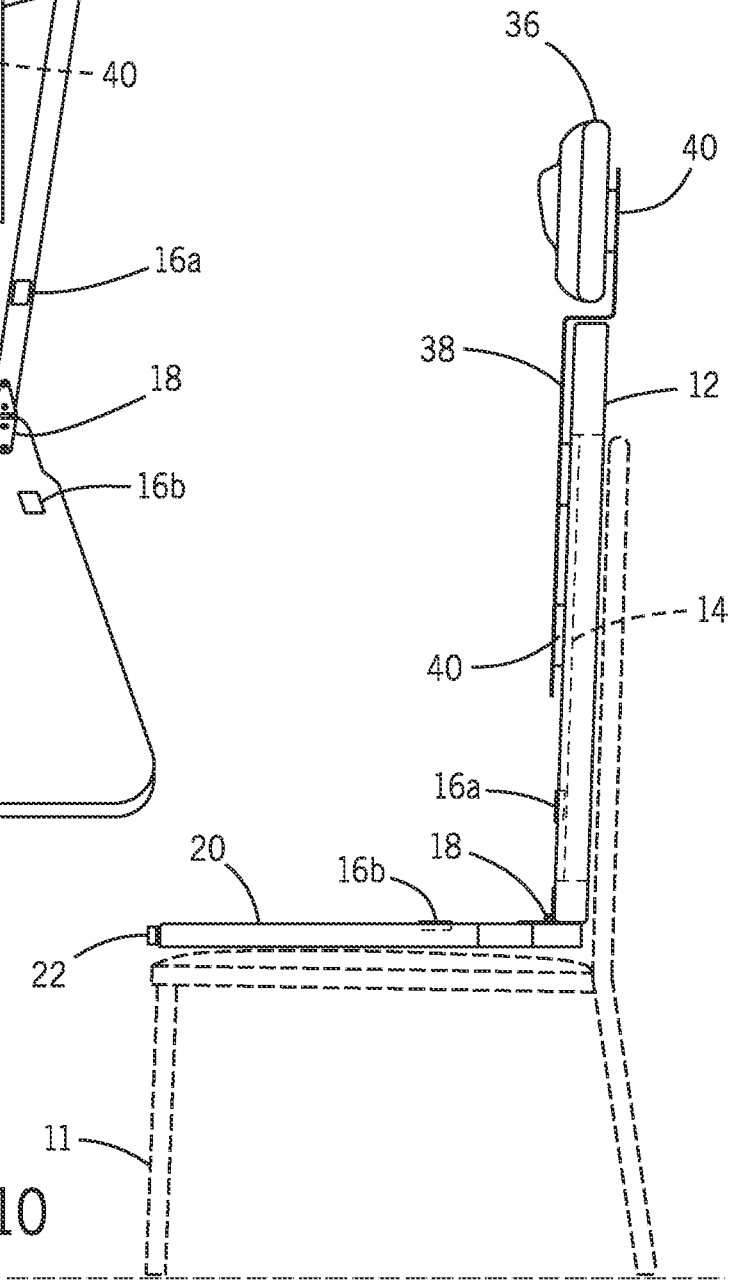
FIG. 10 is a side elevation view of the embodiment of the present invention, similar to FIG. 5, showing the therapeutic aid of the present invention of FIG. 9.

As shown in FIGS. 9-10, a metal extension plate 38 may also be provided, which can be used to further extend the overall height of the unit where the back support 12 may not be tall enough to reach, such as a neck region. As shown with phantom lines in FIG. 9, the extension plate 38 may couple with one or more attachment magnet(s) 40 to the metal back 14, extend upwards beyond a top edge of the back support 12, and provide a region for other attachment magnets 40 to couple thereto. These other attachment magnets 40 may then connect to a neck therapeutic aid, as will be described in greater detail below. As shown in FIG. 10, two bends in the extension plate may be provided such that the therapeutic aid is substantially co-planar with the back support 14.

Advantageously, various therapeutic aids may be provided, as shown in FIGS. 6-10. The following are merely exemplary therapeutic aids to teach those of ordinary skill in the art how one might practice the present invention, as the actual aid type and design thereof has limitless options due to the unique configuration of embodiments described herein. A heating pad 30, a cushion 32, an ointment applicator 34, and a neck massager 36 all may be provided that, as previously mentioned, couple to or are permanently fixed with an attachment magnet 40. These therapeutic aids may be provided entirely separately from embodiments of the present invention or may be provided as part of a kit.

To use, the therapeutic unit 10 is carried, unfolded, and sat on a chair 11 or other appropriate stable seating support (e.g., a bench). Then, one or attachment magnet(s) 40 are placed and/or positioned on the metal back 14 where neck and/or back treatment is needed. Various therapeutic aids may be either coupled to, or already integral with, the attachment magnets 40. A user may then sit down on the seat 20 of the therapeutic unit 10 and lean back onto the various therapeutic aids (e.g., an ointment applicator 34 with ointment applied thereto) that are positioned on the back support 12. If need be, the attachment magnet(s) can be repositioned by the user. In scenarios where neck treatment is needed, the extension plate 38 may be coupled to the metal back 14 and a neck therapeutic aid, such as a neck massager 36, is coupled to the extension plate. When the therapeutic unit 10 is no longer being used, it is folded up and can be moved into a storage space, with the handle 22 making transport of the unit 10 easy for the user.

Methods of making embodiments of the present invention may include the following. To begin, a seat 20 on which the buttocks and thighs rest is formed. It may be firm or cushioned. The underside of the seat has no legs because it is designed to sit on top of another seating surface and is not designed as a free-standing seat itself. A magnetically attractive metal back 14 is attached to a back support 12 (and covers a substantial portion of the back support 12), and the back support 12 and the seat 20 are connected via one or more hinges 18. A handle 22 may be attached to the seat 20. Other items, such as the extension plate 38, attachment magnets 40, and various therapeutic aids, may be manufactured using any appropriate process. The attachment magnets 40 are either permanently or removably connected to the various therapeutic aids.

This therapeutic unit 10 is designed to be used in accordance with virtually any chair 11, from a folding chair to an individual's favorite comfort chair. No matter what the individual's back ailment is, the system of the present invention can pinpoint targeted aid to the problem, whether it is new problem or a persistent problem including, but not limited to: a strain, an ache, dryness, itch, fatigue, etc. This unit 10 can be used by a single person with no help. The application of ointment or lotion would be useful to the elderly or anyone, with it being appliable to the therapeutic aid prior to or after placement on the unit 10. Because of the novel design, users can choose the desired treatment for whatever ails their back or neck and with no instructions needed, alone can treat their ailment with great accuracy via point placement. There is no limit to the accessories that may be created for bones, discs, heart or even injections.

As has been demonstrated by the foregoing, the present invention addresses the need, in a single unit to any portion of the back or neck, for diverse treatment types like: using or applying heat, cold, massage, or stimulation and/or application of ointments or medication to address conditions such as swelling, injury, tension, fatigue, soreness, dryness, itch or simple relaxation. It should be understood, of course, that the foregoing relates to exemplary embodiments of the invention and that modifications may be made without departing from the spirit and scope of the invention as set forth in the following claims.

In the following claims, and in general, any labelling of elements, limitations, steps, or other parts (for example, first, second, etc., (a), (b), (c), etc., or (i), (ii), (iii), etc.) is only for purposes of clarity, and are not to be interpreted as suggesting any sort of ordering or precedence of the claim parts so labelled. If any such ordering or precedence is intended, it will be explicitly recited in the claim or, in some instances, it will be implicit or inherent based on the specific content of the claim. To further aid the USPTO and any readers of any patent issued on this application, it is additionally noted that there is no intent any of the appended claims to invoke paragraph (f) of 35 U.S.C. § 112 as it exists on the date of filing hereof unless the words "means for" or "step for" are explicitly used in the particular claim.

What is claimed is:

1. A therapeutic unit for treating a back, a neck, or the back and the neck of a user, the therapeutic unit comprising:
- a first seat configured for the user to sit thereupon;
- a back support configured to support a back of the user and having a similar width as a width of the first seat;
- a hinge pivotally connecting the first seat and the back support; and
- a metal back connected to the back support and having a similar width as the width of the back support such that a first metal back surface of the metal back covers a majority of a back engaging region of the back support, the metal back being configured to magnetically couple with an attachment magnet such that the attachment magnet is slidably repositionable to all locations on the first metal back surface, the attachment magnet being adapted to couple to a therapeutic aid.

2. The therapeutic unit of claim 1, wherein no seat legs are included as part of the therapeutic unit.

3. The therapeutic unit of claim 1, wherein the metal back comprises a first metal back surface and the first seat comprises a first seat surface, with the first seat and the back support being configured to pivot between:
- a folded position wherein the first metal back surface and the first seat surface are substantially parallel to one another, and
- an unfolded position wherein the first metal back surface and the first seat surface are substantially perpendicular to one another.

4. The therapeutic unit of claim 1, wherein the first seat is configured to be placed on a second seat.

5. The therapeutic unit of claim 4, wherein the second seat is selected from the group consisting of: a chair, a couch, a sofa, a bench, and other seating surfaces.

6. A therapeutic system for treating a back, a neck, or the back and the neck of a user, the therapeutic system comprising:
- a therapeutic unit comprising:
  - a first seat configured for the user to sit thereupon;
  - a back support configured to support a back of the user and having a similar width as a width of the first seat;
  - a hinge pivotally connecting the first seat and the back support; and
  - a metal back connected to the back support and having a similar width as the width of the back support such that a first metal back surface of the metal back covers a majority of a back engaging region of the back support; and
- an attachment magnet magnetically and slidably coupled with the metal back such that the attachment magnet is repositionable to all locations on the first metal back surface, the attachment magnet being adapted to couple to a therapeutic aid.

7. The therapeutic system of claim 6, further comprising:
- an extension plate couplable to the metal back and, when coupled thereto, extending above an uppermost surface of the back support.

8. The therapeutic system of claim 6, wherein the attachment magnet is removable from the metal back.

9. A therapeutic system for treating a back, a neck, or the back and the neck of a user, the therapeutic system comprising:

a therapeutic unit comprising:

a first seat configured for the user to sit thereupon;

a back support configured to support a back of the user and having a similar width as a width of the first seat;

a hinge pivotally connecting the first seat and the back support; and a metal back connected to the back support and having a similar width as the width of the back support such that a first metal back surface of the metal back covers a majority of a back engaging region of the back support;

a first attachment magnet magnetically and slidably coupled with the metal back such that the first attachment magnet is repositionable to all locations on the first metal back surface; and a first therapeutic aid coupled to the first attachment magnet.

10. The therapeutic system of claim 9, wherein the magnetic coupling of the first attachment magnet and the metal back is of sufficient strength such that the first therapeutic aid is maintained in a first position on the metal back.

11. The therapeutic system of claim 9, wherein the first attachment magnet is coupled to a central portion of a rear surface of the first therapeutic aid.

12. The therapeutic system of claim 9, wherein the first attachment magnet is removable from the metal back.

13. The therapeutic system of claim 9, wherein the first therapeutic aid is configured to deliver therapeutic treatment to the user in the form of heat, cold, massage, vibration, ointment application, comfort, support, or combinations thereof.

14. The therapeutic system of claim 13, further comprising:

a second attachment magnet magnetically and slidably coupled with the metal back such that the second attachment magnet is repositionable to all locations on the first metal back surface; and a second therapeutic aid coupled to the second attachment magnet and configured to deliver therapeutic treatment different from the therapeutic treatment of the first therapeutic aid.

15. The therapeutic system of claim 9, further comprising:

an extension plate couplable to the metal back and, when coupled thereto, extending above an uppermost surface of the back support.

* * * * *